US009416614B2

(12) United States Patent
Cain et al.

(10) Patent No.: US 9,416,614 B2
(45) **Date of Patent: *Aug. 16, 2016**

(54) WELLHEAD SYSTEM WITH GASKET SEAL

(71) Applicant: Cameron International Corporation, Houston, TX (US)

(72) Inventors: David Cain, Houston, TX (US); William F. Puccio, Houston, TX (US); Shian J. Chou, Houston, TX (US); Vijay A. Cheruvu, Houston, TX (US); Kirk P. Guidry, Houston, TX (US); Clint Trimble, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/836,431

(22) Filed: Aug. 26, 2015

(65) Prior Publication Data

US 2015/0361753 A1 Dec. 17, 2015

Related U.S. Application Data

(63) Continuation of application No. 14/604,313, filed on Jan. 23, 2015, now Pat. No. 9,133,677, which is a continuation of application No. 13/785,002, filed on Mar. 5, 2013, now Pat. No. 8,960,307.

(60) Provisional application No. 61/606,807, filed on Mar. 5, 2012.

(51) Int. Cl.
*E21B 17/01* (2006.01)
*E21B 19/00* (2006.01)
(Continued)

(52) U.S. Cl.
CPC ..... *E21B 33/038* (2013.01); *E21B 17/01* (2013.01); *E21B 19/002* (2013.01); *E21B 19/006* (2013.01); *E21B 33/035* (2013.01); *E21B 33/04* (2013.01)

(58) Field of Classification Search
CPC ... E21B 19/004; E21B 19/006; E21B 33/038; E21B 33/035; E21B 33/04; E21B 33/043; E21B 17/01
USPC ..... 166/367, 345, 352, 360, 368
See application file for complete search history.

(56) References Cited

U.S. PATENT DOCUMENTS 3,067,820 A * 12/1962 Green ..... E21B 33/03 166/243
4,265,470 A * 5/1981 Danner ..... E21B 17/085 285/319

(Continued)

OTHER PUBLICATIONS

Written Opinion of Singaporean Application No. 11201404573R issued Oct. 20, 2014: pp. 1-13.

*Primary Examiner* — Matthew R Buck
(74) *Attorney, Agent, or Firm* — Chamberlain Hrdlicka

(57) ABSTRACT

An offshore well system for a subsea well. The system includes a floating platform, an external riser and an internal riser nested within the external riser. A external riser tension device tensions the external riser. The drilling system also includes a surface wellhead system that includes a wellhead, a collet, and a flange assembly. The wellhead, collet, and flange assembly are assembled to establish a common bore for receiving the top of the internal riser. A gasket located between the top of the internal riser and an inner shoulder of the flange assembly seals between the wellhead system and the top of the internal riser. The surface wellhead system also retains the internal riser in tension with the wellhead, the internal riser extending above the wellhead into the collet.

20 Claims, 3 Drawing Sheets

(51) Int. Cl.
*E21B 33/035* (2006.01)
*E21B 33/038* (2006.01)
*E21B 33/04* (2006.01)

(56) References Cited

U.S. PATENT DOCUMENTS 4,619,324 A * 10/1986 Couch ..... E21B 33/038 166/340
4,794,988 A * 1/1989 van Bilderbeek ..... E21B 33/043 166/345
4,938,289 A * 7/1990 Van Bilderbeek .... E21B 33/043 166/342
RE34,071 E * 9/1992 Van Bilderbeek .... E21B 33/043 166/342
5,524,710 A * 6/1996 Shinn ..... E21B 19/006 166/348
5,671,812 A * 9/1997 Bridges ..... E21B 33/038 166/348
5,878,816 A * 3/1999 Lalor ..... E21B 33/043 166/268
5,944,111 A * 8/1999 Bridges ..... E21B 33/043 166/348
5,971,076 A 10/1999 Taylor et al.
6,065,542 A * 5/2000 Lalor ..... E21B 33/043 166/203
6,273,193 B1 * 8/2001 Hermann ..... E21B 7/128 166/350
6,763,891 B2 7/2004 Humphrey et al.
8,960,307 B2 * 2/2015 Cain ..... E21B 33/038 166/345
2005/0001427 A1 * 1/2005 Liew ..... F16L 37/002 285/322
2008/0087415 A1 * 4/2008 McGuire ..... E21B 17/1007 166/85.1
2010/0018716 A1 * 1/2010 Leonard ..... E21B 19/004 166/345
2015/0129236 A1 5/2015 Cain et al.

* cited by examiner

WELLHEAD SYSTEM WITH GASKET SEAL

BACKGROUND

Drilling offshore oil and gas wells includes the use of offshore platforms for the exploitation of undersea petroleum and natural gas deposits. In deep water applications, floating platforms (such as spars, tension leg platforms, extended draft platforms, and semi-submersible platforms) are typically used. One type of offshore platform, a tension leg platform ("TLP"), is a vertically moored floating structure used for offshore oil and gas production. The TLP is permanently moored by groups of tethers, called a tension legs or tendons that eliminate virtually all vertical motion of the TLP due to wind, waves, and currents. The tendons are maintained in tension at all times by ensuring net positive TLP buoyancy under all environmental conditions. The tendons stiffly restrain the TLP against vertical offset, essentially preventing heave, pitch, and roll, yet they compliantly restrain the TLP against lateral offset, allowing limited surge, sway, and yaw. Another type of platform is a spar, which typically consists of a large-diameter, single vertical cylinder extending into the water and supporting a deck. Spars are moored to the seabed like TLPs, but whereas a TLP has vertical tension tethers, a spar has more conventional mooring lines.

These offshore platforms typically support risers that extend from one or more wellheads or structures on the seabed to a surface wellhead on the platform on the sea surface. The risers connect the subsea well with the platform to protect the fluid integrity of the well and to provide a fluid conduit to and from the wellbore.

The risers that connect the surface wellhead to the subsea wellhead can be thousands of feet long and extremely heavy. To prevent the risers from buckling under their own weight or placing too much stress on the subsea wellhead, upward tension is applied, or the riser is lifted, to relieve a portion of the weight of the riser. Since offshore platforms are subject to motion due to wind, waves, and currents, the risers must be tensioned so as to permit the platform to move relative to the risers. Accordingly, the tensioning mechanism must exert a substantially continuous tension force to the riser within a well-defined range to compensate for the motion of the platform.

An example method of tensioning a riser includes using buoyancy devices to independently support a riser, which allows the platform to move up and down relative to the riser. This isolates the riser from the heave motion of the platform and eliminates any increased riser tension caused by the horizontal offset of the platform in response to the marine environment. This type of riser is referred to as a freestanding riser.

Hydro-pneumatic tensioner systems are another example of a riser tensioning mechanism used to support risers. A plurality of active hydraulic cylinders with pneumatic accumulators is connected between the platform and the riser to provide and maintain the necessary riser tension. Platform responses to environmental conditions that cause changes in riser length relative to the platform are compensated by the tensioning cylinders adjusting for the movement.

With some floating platforms, the pressure control equipment, such as the blow-out preventer and a drilling wellhead, is dry because it is installed at the surface rather than subsea. In some such cases, a nested, dual-riser system may be required where one riser is installed inside another riser. The riser or one of the two risers connecting the subsea wellhead with the surface wellhead may also be held in tension by pulling the riser in tension and then landing the riser in the surface wellhead supported by the platform. The outside of the riser is sealed against the inner diameter of the wellhead using an annular seal. These annular seals however are subject to relative motion between the riser and the wellhead due to the movement of the platform as well as the movement of the equipment above the wellhead. This relative movement presents a potential source of wear on the seal and the seal surfaces.

BRIEF DESCRIPTION OF THE DRAWINGS

For a detailed description of the preferred embodiments of the invention, reference will now be made to the accompanying drawings in which.

DETAILED DESCRIPTION

Figure 1:
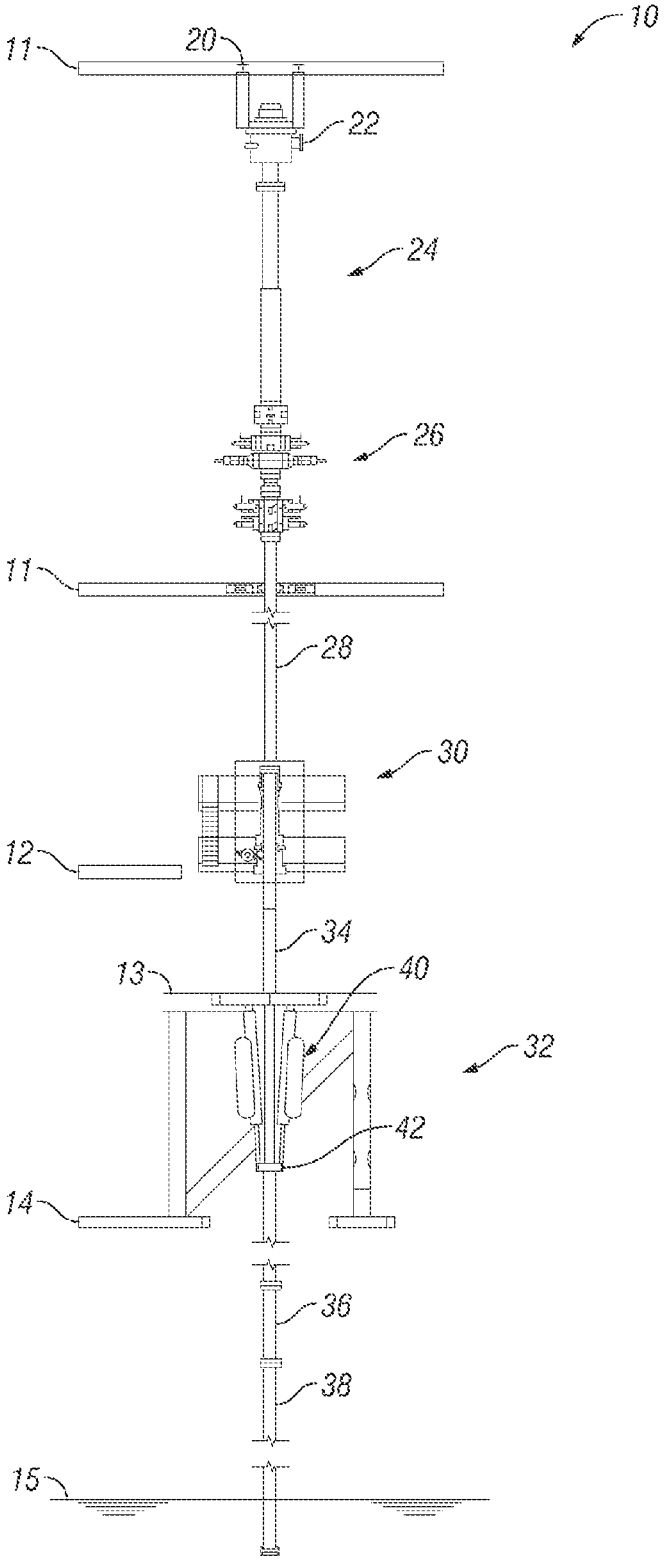
FIG. 1 shows an off-shore sea-based drilling system in accordance with various embodiments.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, a schematic view of an offshore drilling system 10 is shown. The drilling system 10 includes a floating platform (only shown in parts) including drill floors 11, a mezzanine deck 12, a tensioner deck 13, and a production deck 14 located above sea level 15. The drilling system 10 is equipped with a rotary table 20, a diverter 22, a telescopic joint 24, a surface blowout preventer ("BOP") unit 26, and a BOP spool 28. The rotary table 20 revolves to turn the drillstring for drilling the well. Alternatively, the platform may include a topdrive or other rotary means. The diverter 22 seals against the drillstring and diverts return drilling mud to the recirculation equipment. The telescopic joint 24 allows relative movement between the BOP unit 26 and the diverter 22 by allowing an inner pipe to move within an outer pipe. The BOP spool 28 connects the BOP unit 26 with a surface wellhead system 30.

Below the wellhead system 30, the riser system 32 extends below the sea level 15 and connects with the subsea well. The riser system 32 maintains fluid integrity from a subsea wellhead (not shown) to the surface wellhead system 30 and is attached at its lower end to the subsea wellhead using an appropriate connection. For example, the riser system 32 may include a wellhead connector with an integral stress joint. As an example, the wellhead connector may be an external tie back connector. Alternatively, the stress joint may be separate from the wellhead connector. Appropriate equipment for installation or removal of the riser system 32, such as a riser running tool and spider, may also be located on the platform. The riser system 32 shown is a dual-barrier, nested riser system 32 including an internal riser installed inside an external riser, the external riser terminating at the wellhead system 30 with the internal riser extending into the wellhead system 30. However, it should be appreciated that the riser system 32 needs not be a dual-barrier system and may instead include only a single riser.

Drilling of the subsea well is carried out by a string of drill pipes connected together by tool joints so as to form a drill string extending subsea from the platform. Connected to the lower end of the drill string is a drill bit. The bit is rotated by rotating the drill string and/or a downhole motor (e.g., downhole mud motor). Drilling fluid, also referred to as drilling mud, is pumped by mud recirculation equipment (e.g., mud pumps, shakers, etc.) disposed on the platform. The drilling mud is pumped at a relatively high pressure and volume down the drill string to the drill bit. The drilling mud exits the drill bit through nozzles or jets in face of the drill bit. The mud then returns to the platform at the sea surface via an annulus between the drill string and the borehole, through the subsea wellhead at the sea floor, and up an annulus between the drill string and the riser system 32. At the platform, the drilling mud is cleaned and then recirculated by the recirculation equipment. The drilling mud is used to cool the drill bit, to carry cuttings from the base of the borehole to the platform, and to balance the hydrostatic pressure in the rock formations. Pressure control equipment such as the BOP unit 26 is located on the floating platform and connected to the riser system 32.

As shown, the riser system 32 includes a tension joint 34, a transition joint 36, and the external riser string 38 that extends to the subsea wellhead. To maintain the riser system 32 under appropriate tension, a riser tension system 40 is attached to the tension joint 34 by a tensioner ring 42 on the external riser. The riser tension system 40 is supported on the tensioner deck 13 of the platform and dynamically tensions the riser system 32. This allows the tension system 40 to adjust for the movement of the platform while maintaining the external riser under proper tension. The riser tension system 40 may be any appropriate system, such as a hydro-pneumatic tensioner system as shown. Also, it should be appreciated that in a single riser system, the external riser and associated tensioning equipment may not be necessary. Also, although not shown, the gasket seal discussed above may also be used with a production riser terminating in a surface wellhead/production tree.

Figure 2:
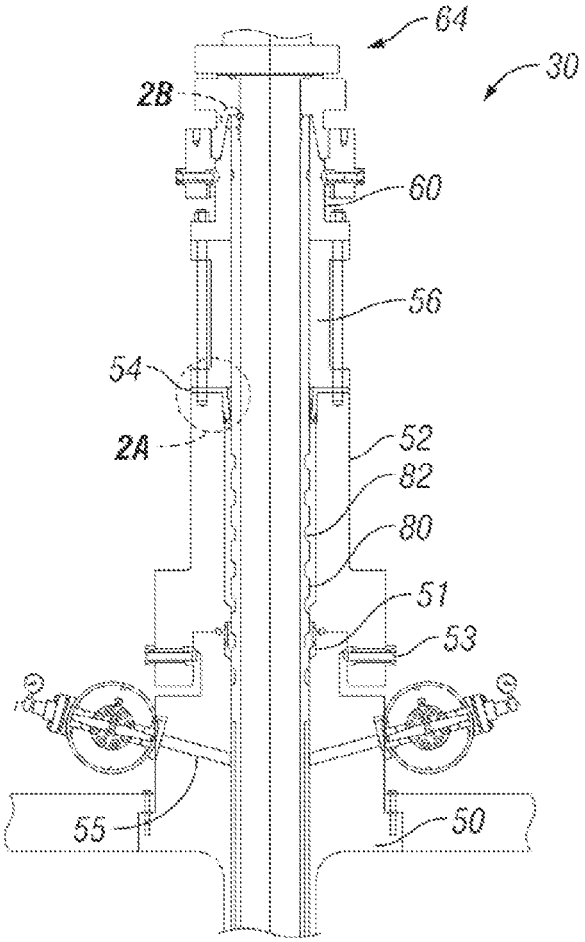
FIG. 2 shows a surface wellhead system in accordance with various embodiments.
Figure 3:
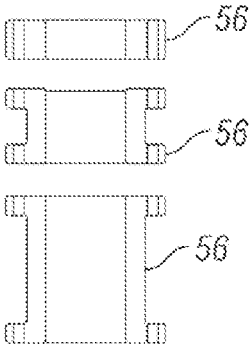
FIG. 3 shows optional wellhead system spacer spools.
Figure 4:
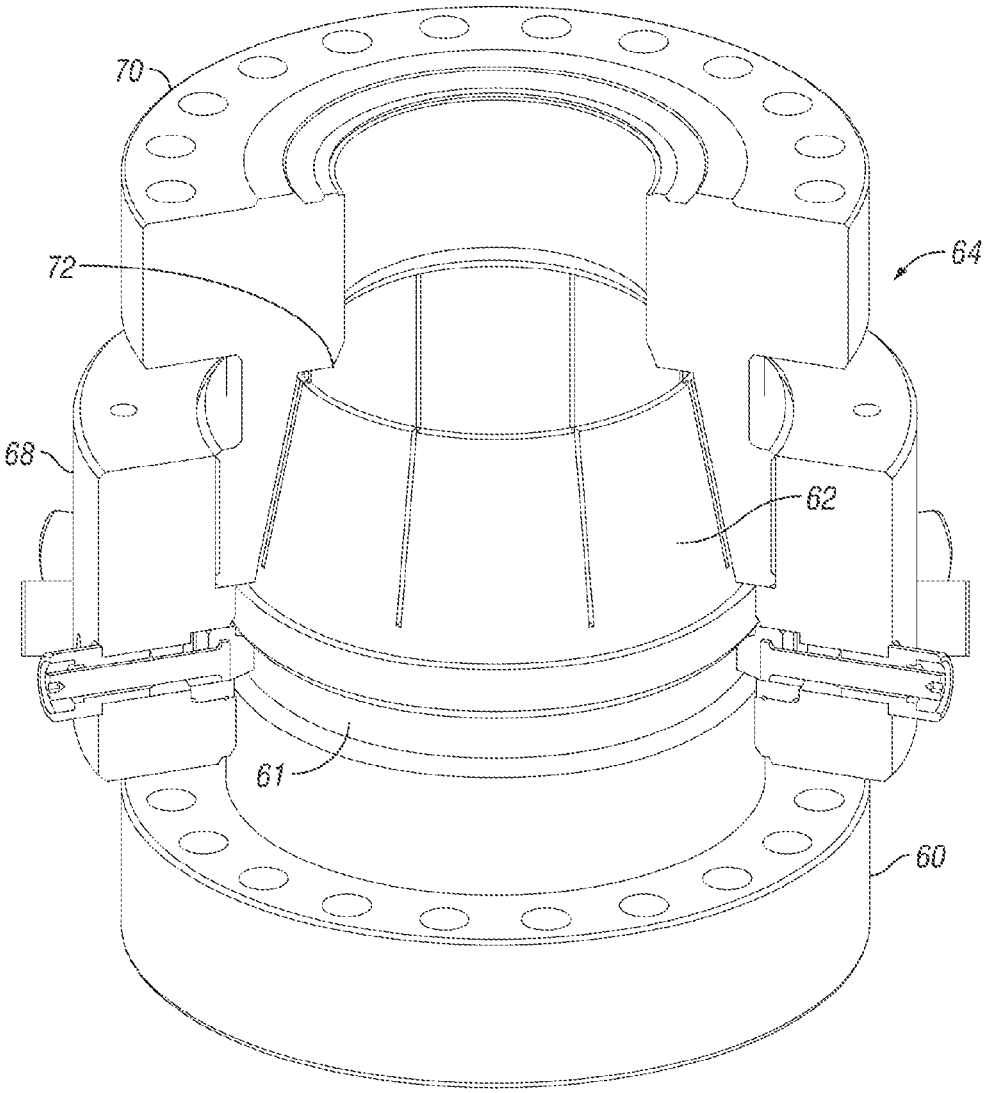
FIG. 4 shows the collet and flange assembly of the wellhead system in accordance with various embodiments.

As more clearly shown in FIGS. 2-4, the wellhead system 30 includes a wellhead 50, a spool 52, at least one spacer spool 56, a collet 60, and a flange assembly 64. The external riser extends to the bottom of the wellhead 50. The internal riser 80 extends past the top of the external riser and into the wellhead system 30.

The wellhead 50 includes a load shoulder 51 for landing the internal riser 80 in tension. Before the remaining portions of the wellhead system 30 are installed onto the wellhead 50, the internal riser 80 is pulled into tension to prevent buckling. The final height of the internal riser 80 relative to the wellhead 50 once the riser 80 is pulled into tension may vary depending on the dimensions and design of the overall drilling system 10. To accommodate for different heights, the internal riser 80 includes annular grooves 82 spaced along the length of a portion of the internal riser 80. The landing shoulder 51 and the grooves 82 cooperate by accepting a load ring that allows the internal riser 80 to land on the load shoulder 51 and remain in tension. The load shoulder 51 supports the load of the internal riser 80 in tension and transfers that load to the platform. As shown, the load ring may be in multiple sections, such as a split ring and false bowl. The load ring may be designed for other configurations as well.

Also included in the wellhead 50 is at least one port 55 extending through the wall of the wellhead from the bore inside the wellhead 50 to outside the wellhead 50. The port(s) 55 allow access to the annulus between the wellhead 50 and the internal riser 80 and, in a dual-barrier riser system as shown, the annulus between the inner and external riser. The port(s) 55 may be angled as shown to allow insertion of a fluid line into the annulus for injecting gas to evacuate liquid in the annulus or other annulus control operations.

With the riser 80 in tension and supported by the wellhead 50, the spool 52 is then installed by placing it over the riser 80 and connecting it with the wellhead 50 using connectors 53. The connectors 53 may be designed to run in on threads such as FASTLOCK™ connectors by Cameron International Corporation or may be designed as any other suitable type connector.

On top of the spool 52, one or more spacer spools 56 are installed to accommodate the final height of the internal riser 80. As shown in FIG. 3, the spacer spool(s) 56 may be different sizes and may be installed in different combinations to match the final height of the internal riser 80. In addition to accommodating different heights, the spacer spool(s) 56 is also used for structural integrity. The spacer spool(s) 56 is designed to be of such material so as to create stiffness and thus structural rigidity to the entire wellhead system 30, decreasing the amount of relative motion between the internal riser 80 and the wellhead system 30.

On top of the spacer spool(s) 56 is a collet 60 and a flange assembly 64, which are more clearly shown in FIG. 4. The collet 60 includes a bottom flange, a cylindrical middle portion, and a tapered upper portion including collapsible fingers 62. Returning to FIG. 2, the collet 60 is installed by inserting bolts that extend through a flange on the bottom of the collet 60, a flange on the top of the upper spacer spool 56, and into the spool 52. Nuts are tightened on top of the bolts for the final connection. It should be appreciated that other connectors may be used to connect the spool 52, the spacer spool(s) 56, and the collet 60 as well.

Figure 2A:
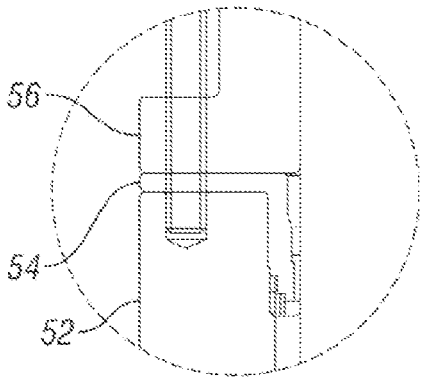
FIG. 2A shows a close-up of an end cap seal used in the wellhead system.

As shown more clearly in the insert FIG. 2A, included at a junction between spool 52, the spacer spool(s) 56, and the collet 60 is a riser seal 54 that seals against the outside of the internal riser 80. As an example, the riser seal 54 shown is a Metal End Cap seal installed between the spool 52 and the spacer spool 56. However, the riser seal 54 may be made of any suitable material such as elastomer and may be located at any junction between the collet 60 and the spool 52. More than one riser seal 54 may also be used.

Figure 2B:
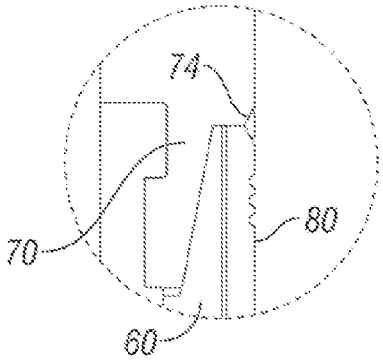
FIG. 2B shows a close-up of a gasket seal in the wellhead system.

As shown in FIGS. 2, 2B, and 4, the flange assembly 64 is installed on top of the collet 60 and the internal riser 80. The flange assembly 64 includes a connector hub 68 and a flange sleeve 70 threaded into the connector hub 68. The flange sleeve 70 includes an inner tapered portion that matches the outer taper of the collet fingers 62. The flange assembly 64 is installed on the collet 60 by placing the flange assembly 64 on top of the collet 60 and tightening the connectors in the connector hub 68. As shown, the connectors are designed to run in on threads such as FASTLOCK™ connectors by Cameron International Corporation but the connectors may be designed as any other suitable type connector. As they are run in, the connectors engage the channel 61 in the collet 60 that has angled side walls. The shape and alignment the connectors with the channel 61 are designed such that as the connectors are run in, the flange assembly 64 is pulled down onto the collet 60. When pulled down, movement of the inner tapered portion of the flange sleeve 70 relative to the collet 60 collapses the fingers 62 of the collet 60 against the outside of the internal riser 80. Collapsing the collet fingers 62 causes the fingers 62 to grip the outside of the internal riser 80 and adds additional structural integrity to the connection between the wellhead system 30 and the internal riser 80.

As shown most clearly in FIG. 2B and FIG. 4, the flange sleeve 70 also includes an inner shoulder 72 that extends inward from the top of the collet 60. Included between the shoulder 72 and the top of the internal riser 80 is a gasket 74 for sealing between the wellhead system 30 and the internal riser 80. The gasket 74 may be any suitable design and material, such as a style BX gasket. In addition to collapsing the collet fingers 62, pulling down the flange assembly 64 also energizes the gasket 74 to form the seal between the top of the internal riser 80 and the wellhead system 30. Being located on the end of the internal riser 80, the gasket 74 is not subject to the same potential wear as a seal around the outside of the internal riser 80 because there is no relative movement between the internal riser 80 and the wellhead system 30 at this location.

On top of the flange sleeve 70 is an upper flange, such as an API flange, for connection with the BOP spool 28 and the BOP unit 26.

Although the present invention has been described with respect to specific details, it is not intended that such details should be regarded as limitations on the scope of the invention, except to the extent that they are included in the accompanying claims.

What is claimed is:

1. An offshore system including a surface wellhead and a riser extendable through and adjustably landable within the wellhead, including:

a spool attachable to the wellhead;

a flange assembly located above the spool; and a gasket configured to be located between and in contact with a top surface of the riser and the flange assembly such that the gasket forms a seal between the flange assembly and the top surface of the riser.

2. The system of claim 1, wherein engagement of the flange assembly with the riser is configured to energize the gasket to form the seal against the riser.

3. The system of claim 2, wherein the engagement of the flange assembly with the riser compresses the gasket to form the seal.

4. The system of claim 1, wherein the riser extends through the spool.

5. The system of claim 1, further including a spacer spool attachable to the spool and configured to position the flange assembly to accommodate the height of the riser.

6. The system of claim 5, further including at least one additional spacer spool.

7. The system claim 6, wherein at least two of the spacer spools are different sizes.

8. The system of claim 7, further comprising more than two spacer spools, the spacer spools being installable in different configurations to accommodate different heights of the riser.

9. An offshore system including a surface wellhead and a riser extendable through and adjustably landable within the wellhead, comprising:

a collet attachable to the wellhead;

a flange assembly attachable to the collet; and a gasket configured to be located between and in contact with a top surface of the riser and the flange assembly such that the gasket forms a seal between the flange assembly and the top surface of the riser.

10. The system of claim 9, wherein engagement of the flange assembly with the collet is configured to energize the gasket to form the seal against the riser.

11. The system of claim 10, wherein the engagement of the flange assembly with the collet compresses the gasket to form the seal.

12. The system of claim 9, wherein the riser extends through the collet.

13. The system of claim 9, wherein the collet further comprises a tapered upper portion comprising collapsible fingers configured to collapse to grip the outside of the riser.

14. The system of claim 13, wherein:

the flange assembly further comprises an inner tapered portion that matches the collet tapered upper portion; and engagement of the flange assembly inner tapered portion with the collet tapered upper portion is configured to collapse the collapsible fingers against the outside of the riser to grip the outside of the riser.

15. The system of claim 9, further including a spacer spool attachable between the wellhead and the collet and configured to position the collet and flange assembly position to accommodate the height of the riser.

16. The system of claim 15, further including at least one additional spacer spool.

17. The system claim 16, wherein at least two of the spacer spools are different sizes.

18. The system of claim 17, further comprising more than two spacer spools, the spacer spools being installable in different configurations to accommodate different heights of the riser.

19. An offshore system including a surface wellhead and a riser extendable through and adjustably landable within the wellhead, comprising:

a spool attachable to the wellhead;

a gripping mechanism attachable to the spool and configured to grip an outer surface of the riser;

a flange assembly attachable to the gripping mechanism; and a gasket located between a top surface of the riser and the flange assembly, the gasket configured to form a seal between the flange assembly and the top surface of the riser.

20. The system of claim 19, wherein the gripping mechanism is selected from one of a collet and a dog.

* * * * *